United States Patent [19]

Falcetti

[11] Patent Number: 4,579,469

[45] Date of Patent: Apr. 1, 1986

[54] COOLING APPARATUS FOR DOT MATRIX PRINTING HEAD

[75] Inventor: Carlo Falcetti, Cornaredo, Italy

[73] Assignee: Honeywell Information Systems Italia, Milan, Italy

[21] Appl. No.: 703,072

[22] Filed: Feb. 19, 1985

[30] Foreign Application Priority Data

Mar. 24, 1984 [EP] European Pat. Off. ..... 84103273.3

[51] Int. Cl.[4] ..... B41J 29/00

[52] U.S. Cl. ..... 400/124; 101/93.05; 400/719

[58] Field of Search ..... 400/719, 124; 101/93.05

[56] References Cited

FOREIGN PATENT DOCUMENTS

| | | | |
|---|---|---|---|
| 57-22070 | 2/1982 | Japan | 400/719 |
| 57-131587 | 8/1982 | Japan | 400/719 |
| 57-187272 | 11/1982 | Japan | 400/719 |
| 58-29691 | 2/1983 | Japan | 400/719 |
| 58-42483 | 3/1983 | Japan | 400/719 |

*Primary Examiner*—Edgar S. Burr
*Assistant Examiner*—Moshe I. Cohen
*Attorney, Agent, or Firm*—Nicholas Prasinos; John S. Solakian

[57] ABSTRACT

A cooling apparatus for a dot matrix impact print head suitable for application in serial printers. The print head is mounted on a carriage sliding on guide bars for reciprocating movement thereon. A liquid filled container having an inlet and outlet is mounted on the carriage and is in thermal contact with the printing head. A heat dissipator also mounted on the printer has a liquid filled cavity with inlet and outlet with flexible conduits connected to the inlets and outlets so as to form a liquid circulation loop. A unidirectional fluid valve in said loop maintains liquid circulation in the loop by the reciprocating movement of the liquid container.

In the preferred form of embodiment the liquid container is formed integral with the print head, the liquid in the container being in direct contact with electromagnetic cores of the print head, and the heat dissipator is formed by a guiding bar, the bar being hollow and having an inlet and outlet.

4 Claims, 2 Drawing Figures

COOLING APPARATUS FOR DOT MATRIX PRINTING HEAD

BACKGROUND OF THE INVENTION

1. Field of the Invention

The invention relates to a cooling apparatus for a dot matrix impact print head of the kind used in dot matrix serial printers.

2. Description of the Prior Art

It is known that in dot matrix serial printers a printing head slidably mounted on guide bars is moved along a print line in front of and transverse to a print support to perform printing thereon. The print head includes a set of printing needles or equivalent elements, which are energized by a corresponding set of electromagnets, to transfer, by impact pressure, the pigment of an inked ribbon to the printing support. In spite of the several improvements which have been adopted in the art to increase the efficiency of electromagnets, most of the electrical power supplied to the electromagnetic actuators, is not converted to printing work, but it is wasted in hysteresis losses within the magnetic materials forming the electromagnet cores and in resistive losses within the electromagnet coils. These losses develop heat which must be dissipated. Heat dissipation is usually obtained by thermal exchange with the air surrounding the print head because of the difference in temperature which arises between the print head body and the surrounding air. To improve the thermal exchange and to limit the thermal step between air and print head, cooling elements are often used which increase the thermal exchange surface by means of finger or wing shaped portions. The print head movement is further utilized to increase the thermal transfer, and in some cases air flow is further induced by fans.

In spite of these expedients, print head overheating is often a problem especially in case of high speed printing heads. This problem has not been completely overcome. Thus in order to prevent print head damage, thermal sensors are used, which senses the temperature in the printing head and which inhibit its further operation when a preestablished temperature ceiling is reached. The heating problem becomes further crucial in those printers where, in order to reduce the noise caused by the electromagnet, the operation of the whole print head is enclosed in a noise deadening material which greatly reduces the thermal conductivity of the print head body and substantially causes the thermal isolation of the print head. Some form of indirect cooling may overcome such problem. For instance, liquid cooling is much more efficient than air cooling; but to be effective a complex and relatively expensive apparatus is required, involving the use of a pump, and heat radiators. As far as is known, no attempts have been made in this direction. The invention, as claimed, is intended to remedy these drawbacks.

OBJECTS OF THE INVENTION

It is an object of the invention to provide improved cooling apparatus for an impact print head.

It is another object of the invention to provide improved liquid cooling apparatus for an impact type print head.

SUMMARY OF THE INVENTION

The invention solves the problem of providing liquid cooling of a print head with a very simple and inexpensive means. Basically the invention originates from the simple consideration that the print head, when in operation, is affected by a reciprocating movement along the print line and that such movement can be used to induce a relative displacement of a fluid surrounding the printing head, due to the fluid inertia. Thus the print head itself may be used as a pumping element. A second consideration is that the guiding bars, used for guiding the print head in its reciprocating movement can be used as coolers. In fact they are usually made of steel and inherently have a high thermal conductivity. Thus the guiding bars may substitute for any additional cost increasing heat radiator. In some cases the platen or some suitable portion of the printer frame may also be used as a heat radiator. Therefore the invention, as claimed, may be carried out by a suitable and inexpensive modification of elements already existing in serial printers, with the sole addition of inexpensive fluid conduits.

BRIEF DESCRIPTION OF THE DRAWINGS

The features and the advantages of the invention will appear more clearly from the following description of a preferred embodiment and from the attached drawings wherein.

DETAILED DESCRIPTION OF THE PREFERRED EMBODIMENT

Figure 1:
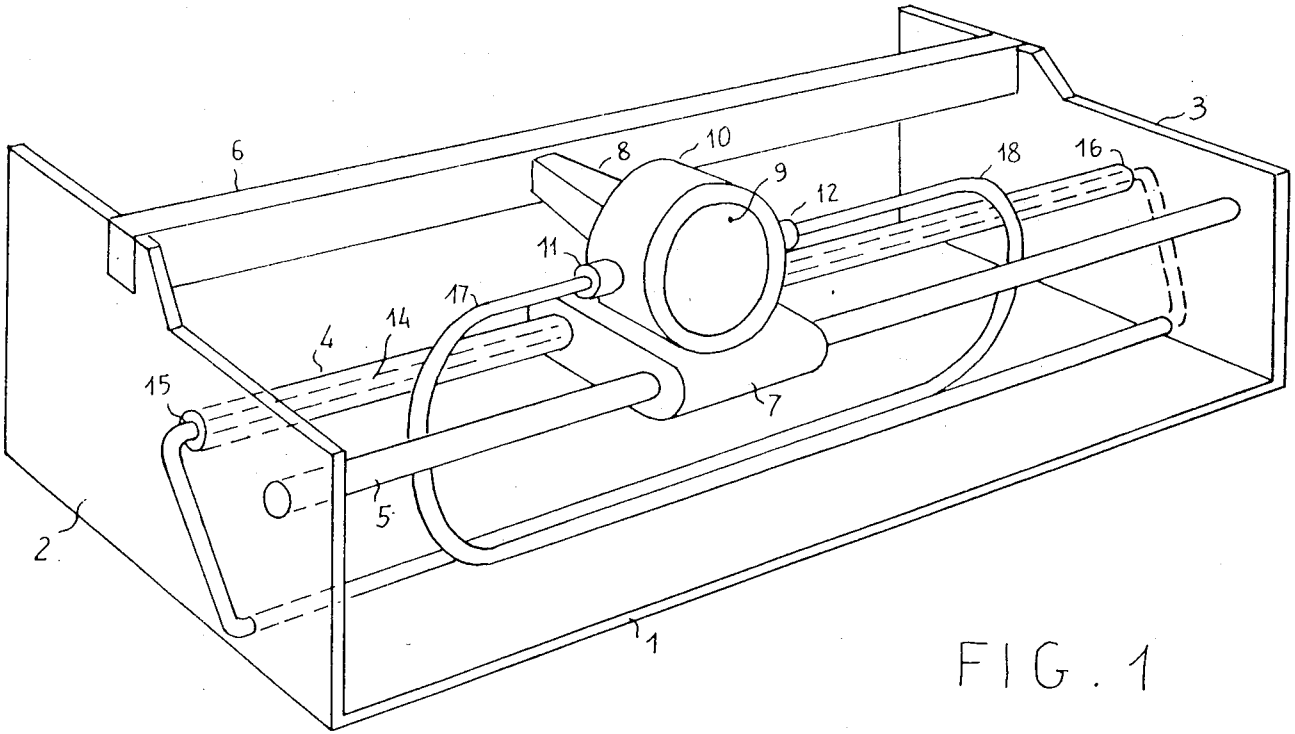
FIG. 1 is a perspective view of a serial printer frame including the cooling apparatus of the invention.

Referring to FIG. 1, a serial printer frame is comprised of a base plate 1, two side plates 2, 3, two parallel cylindrical bars 4, 5 fixedly mounted between the side plates, and a platen 6. The platen may be either in the form of a cylindrical drum rotatably mounted between the side plates, or a prismatic bar fixedly mounted between the side plates, as shown in FIG. 1. A carriage 7 is slidably mounted on the guiding bars 4, 5 and coupled by transmission means, not shown, to a motor. By suitable energization of the motor the carriage 7 may be moved along the bars 4, 5 in both directions in a reciprocating movement. A print head is fixedly mounted on carriage 7. As known, the print head is basically composed of a needle guiding group in the form of a nose 8 and an electromagnet group 9. When the carriage moves along the guiding bars, the print head mounted thereto traverses a printing support, not shown, laid down onto the platen, so that by suitable and selective energization of the electromagnets in the print head, the needles are selectively actuated to perform dot impressions on the printing support. In order to understand the invention no further details are required as to the structure of the dot matrix printer, which details may be easily found in the literature.

As to the print head, U.S. Pat. No. 4,260,270 is exemplary of a dot matrix printing head structure and the European Patent Application published with No. 58901 corresponding to U.S. Pat. No. 4,433,927 shows a preferred embodiment of electromagnet assembly for dot matrix printing head.

When the electromagnets in the electromagnet group 9 are energized, hysteresis losses, eddy current losses and resistive losses occur so that the electromagnet group 9 may be taken as a source of heat which must be dissipated. According to the invention the electromagnet group 9 is surrounded by a toroidal body 10 in thermally conductive contact with the electromagnet group 9 and preferably in direct thermally conductive contact with some portion of the electromagnet cores. As is more clearly shown in FIG. 2, the toroidal body 10 is hollow. The body 10 has an inlet 11 to the cavity and an outlet 12. Guiding bar 4, too, is hollow and its cavity 14 has an inlet 15 and an outlet 16. A flexible, plastic or rubber conduit 17 connects the inlet 11 to the outlet 16 and a flexible, plastic or rubber conduit 18 connects the outlet 12 to the inlet 15, so that a circulation loop for a fluid is obtained. The cavity in body 10, the bar cavity 14 and the conduits 17, 18 are filled with refrigerating liquid, preferably a non-electrically conductive liquid, such as oil. Inlet 11 is provided, as more clearly shown in FIG. 2, with a no return or unidirectional stop valve, so that liquid may flow from conduit 17 into the body 10, but not vice versa.

It is clear that when the print head is accelerated from the right side of the printer frame, as shown in FIG. 1, to the left side, the liquid contained in body 10 cavity, due to its inertia, is partially drained in conduit 18 and the liquid contained in conduit 17 is partially suctioned in the body 10 cavity to replace the same liquid amount which left the cavity. In this way a fluid flow is established in the fluid loop. When the print head is decelerated to stop at the left side of the printer frame, the reverse fluid flow is prevented by the unidirectional stop valve provided in the loop. In the same way, when the print head is accelerated from the left side to the right side of the printer, no reverse fluid occurs, and a direct fluid flow occurs when the print head is decelerated to stop at the right side of the printer frame. It is therefore clear that heat developed in the electromagnet group is transferred by thermal conductivity to the liquid in the hollow body 10 and it is taken from the hollow body 10 and brought into cavity 14 of bar 4 because of the liquid flow in the path. Even assuming that body 10 and conduits 17, 18 does not dissipate heat, because they may be thermally insulated from the surrounding air, or because of a very low thermal conductivity, liquid cooling may be provided by bar 4. Bar 4 is usually a steel bar, and therefore it is characterized by a high thermal conductivity. Moreover, it offers a broad surface for thermal exchange with the surrounding air, and further being placed in a horizontal position induces air convective flow along its full length, which flow enhances the thermal exchange.

Figure 2:
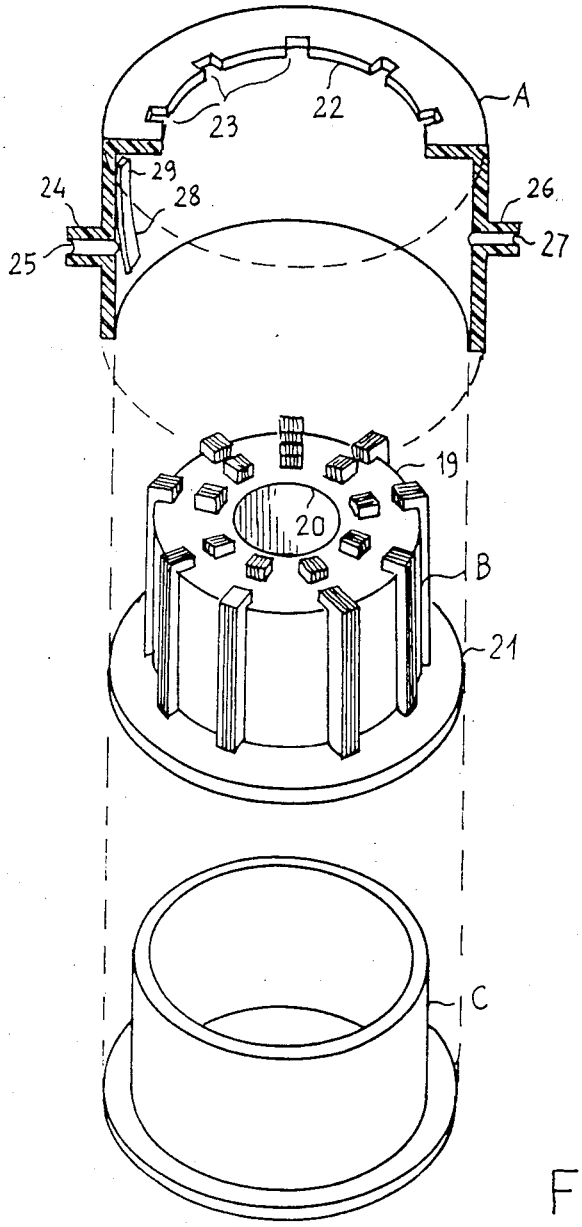
FIG. 2 is a perspective exploded view of a printing head portion suitably modified in accordance with the invention.

FIG. 2 shows, in exploded view, two preferred forms of embodiments of the hollow toroidal body 10. In the first form the body 10 is integral to the electromagnet group 9. The above-mentioned European patent application published with No. 58901 discloses a preferred embodiment of electromagnet assembly where the individual electromagnet cores and related energization coils of a printing head are enclosed, by a molding process, in heat hardened plastic forming a unitary assembly. Such assembly is shown as B in FIG. 2. Assembly B is essentially shaped as a cylindrical plastic body 19 provided with a central cylindrical opening 20 and with a toroidal neck 21 having a diameter slightly greater than the one having cylindrical body 19. The cores of the electromagnets are radially and uniformly arranged within the plastic assembly with bare portions of the cores protruding from the outer cylindrical surface of the body. This kind of assembly may be used to obtain a hollow body 10 integral thereto. For this purpose it suffices to have a plastic molded cap, as the one shown as A in FIG. 2. Cap A in the form of a cylindrical bushing, as an inner diameter equal to the diameter of neck 21. The bushing is provided with a toroidal neck 22 projecting inwardly and having a diameter equal to the diameter of cylindrical body 19. Toroidal neck 22 is provided with suitable indentations 23, mating that portion of the cores which protrude from body 19. Bushing A is further provided with an input pipe fitting 24 and related inlet opening 25 and with an output pipe fitting 26 and related outlet opening 27. A unidirectional stop valve is formed at inlet 25 by means of flexible plastic or rubber tongue 28 fixed from its upper portion 29 to the inner wall of cap A. Cap A is inserted on assembly B so as to form, together with assembly B, the toroidal hollow body 10 of FIG. 1. Obviously cap A is bound to assembly B by glueing, thermocompression or any other suitable means which may provide a sealing of the recess so formed thereafter to be filled with liquid. It is clear that the body so formed provides for an optimized thermal transfer, between the heat source and the cooling liquid because the liquid is in direct contact with the cores. While simple, inexpensive and efficient, the body so formed has the disadvantage that being integral to the electromagnet assembly, hence integral to the print head, removal of the print head from the printer for replacement, repair or maintenance, is not possible without draining the liquid in the apparatus. Moreover, in case the electromagnet assembly is not enclosed in a unitary assembly, a sealed recess cannot be obtained by the mere use of a cap as the one shown in FIG. 2.

As an alternative embodiment, hollow body 10 may be obtained by combination of cap A with a bushing as the one shown by C in FIG. 2. Bushing C, preferably in thermally conductive material such as aluminum or plastic with metallic filler substitutes for the electromagnet assembly B. The shape and size of bushing C, shown as a hollow cylinder, may be suitably arranged for establishing good mechanical contact with the elements from which heat has to be drained. With this alternative embodiment it is clear that removal of the print head from the printer does not require draining of the cooling apparatus.

It is clear that the cooling apparatus described in connection with FIGS. 1 and 2 is only a preferred embodiment of the invention and that several changes can be made without departing from the scope of the invention. In particular:

The liquid containing body shown generally as a collar surrounding the print head may have any form and disposition as to the printing head, provided good thermal conductivity is established between the liquid containing body and the heat source.

The unidirectional valve, may be located anywhere in the fluid loop.

As a heat radiator, it is possible to use both guiding bars 4, 5 as well as platen 6 or other frame elements, in series or parallel each other, provided such elements are made hollow or, if so preferred, a heat radiator other than a functional and already existing element of the printed may be provided.

What is claimed is:

1. A cooling apparatus for a dot matrix impact print head, suitable for application in serial printers where the print head is mounted on a carriage sliding on guiding bars for reciprocating movement thereon, and a printing operation is performed on a printing support laid down on a platen during said print head movement, characterized in that it comprises:

a liquid filled container mounted on said carriage and in thermal contact with said printing head, said liquid container having an inlet and outlet;

a heat dissipator comprising one of said guiding bars being a liquid filled cavity and having an inlet and outlet for connection to said liquid filled container;

flexible conduits connecting the inlet of said liquid filled container with the outlet of said heat dissipator cavity and the outlet of said liquid filled container with the inlet of said heat dissipator cavity, whereby a liquid circulation loop is formed; and a unidirectional fluid valve in said loop, so that liquid circulation is induced in said loop by the reciprocating movement of said carriage and said container mounted thereon.

2. A cooling apparatus as claimed in claim 1 characterized in that said unidirectional fluid valve is formed in said liquid filled container at the inlet thereof and consists in a resilient leaf closing and opening said inlet owing to the differential pressure induced on said liquid by the reciprocating movement of said carriage.

3. A cooling apparatus a claimed in claim 1 characterized in that said liquid filled container is formed integrally to said printing head, said printing head having a liquid filled cavity with inlet and outlet formed integrally therein.

4. A cooling apparatus as claimed in claim 3 characterized in that said liquid filled cavity of said print head provides direct contact of said liquid with electromagnetic cores in said print head.

* * * * *